United States Patent [19]

Kazumoto et al.

[11] Patent Number: 4,822,390

[45] Date of Patent: Apr. 18, 1989

[54] CLOSED CYCLE GAS REFRIGERATOR

[75] Inventors: Yoshio Kazumoto; Takuya Suganami; Yoshiro Furuishi; Kazuo Kashiwamura, all of Hyogo, Japan

[73] Assignee: Mitsubishi Denki Kabushiki Kaisha, Tokyo, Japan

[21] Appl. No.: 213,858

[22] Filed: Jun. 30, 1988

[30] Foreign Application Priority Data

Jul. 2, 1987 [JP] Japan ..... 62-165712

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS 3,877,239 4/1975 Leo ..... 62/6

3,991,585 11/1976 Mulder ..... 62/6

FOREIGN PATENT DOCUMENTS 245164 11/1967 European Pat. Off. ..... 62/6

*Primary Examiner*—Steven E. Warner

*Attorney, Agent, or Firm*—Sughrue, Mion, Zinn, Macpeak and Seas

[57] ABSTRACT

A refrigerator has a reciprocation portion including a piston and a portion of a linear motor and having an angular resonance frequency W defined by the following equation:

$$\omega = \sqrt{\frac{1}{m}}\left(\frac{2 \cdot Sp \cdot Pa \cdot \cos\alpha}{S} + Ks\right)$$

where m=total mass of the reciprocation portion

Sp=area of a working surface of the piston

Pa=amplitude of pressure variation of a working gas in a compression space of the refrigerator α=phase difference between a displacement of the piston and pressure variation of the working gas in the compression space S=stroke of the piston Ks=spring constant of a support spring of the piston and an a.c. power source for driving the reciprocation portion, the power source has an angular frequency $W_o$ substantially equal to said angular frequency W with an acceptable error therebetween being ±10%.

5 Claims, 3 Drawing Sheets

$\omega_0$: OPERATING ANGULAR FREQUENCY t : TIME

PISTON TOP DEAD CENTER (TDC) : MINIMUM VOLUME OF COMPRESSION SPACE

PISTON BOTTOM DEAD CENTER (BDC) : MAXIMUM VOLUME OF COMPRESSION SPACE

CLOSED CYCLE GAS REFRIGERATOR

BACKGROUND OF THE INVENTION

The present invention relates to a refrigerator and, paticularly, to a closed cycle gas refrigerator for use in cooling, for example, infrared detectors.

FIG. 4 is a cross section of a conventional gas refrigerator of such type as shown in Japanese Patent Publication No. 28980/1979. In this figure, a reference numeral 1 depicts a cylinder in which a piston 2 and a displacer 3 reciprocate with phases different from each other. A cooler 5 is disposed in a compression space 4 between a working surface 2*a* of the piston 2 and a working surface 3*a* of the displacer 3. An upper working surface 3*b* of the displacer 3 forms a border line of an expansion space 6 which forms, together with the compression space 4, a working space. A regenerator 7 disposed in the displacer 3 can be communicated with a working gas below a center hole 8 therethrough and with a working gas above a radial duct 10 through the latter and a center hole 9. The refrigerator is equipped with a freezer 11 as a heat exchanger for exchanging heat between cold working gas and a material to be cooled.

Seals 12 and 13 are provided between the piston 2 and a wall of the cylinder 1 and seals 14 and 15 are provided between the displacer 3 and the cylinder 1.

The piston 2 has a light weight sleeve 16 of non-magnetic or non-magnetized material such as paper or aluminum on a lower portion thereof, on which an armature coil 17 having lead wires 18 and 19 is wound. The lead wires extend through a wall of a housing 20 connected air-tightly to the cylinder 1 and are connected to electric contacts 21 and 22, respectively. The armature coil 17 is able to reciprocate axially in an annular gap 23, in which an armature magnetic field is established. Magnetic flux of this magnetic field extends radially across moving directions of the armature coil.

A static magnetic field is provided by an annular permanent magnet 24 having magnetic poles at its upper and lower ends, an annular disc 25 of soft iron, a cylinder 26 of soft iron and a circular disc 27 of soft iron, which, all together, constitute a closed magnetic circuit.

Further, the sleeve 16, the armature coil 17, the lead wires 18 and 19, the annular gap 23, the annular permanent magnet 24 and the parts 25, 26 and 27 of soft iron constitute a linear motor 28.

In the conventional refrigerator mentioned above, an a.c. power source is connected through the contacts 21 and 22 to the armature coil 17 to supply a power necessary to operate it. An angular $\omega_o$ frequency of the a.c. power source is substantially equal to an angular resonance frequency $\omega$ of an assembly of the piston 2 and the armature coil 17, which is defined as follows:

$$\omega = \sqrt{\frac{S^2 \cdot Pm}{M \cdot T_o\left(\frac{1}{ac_c}\cdot\frac{Vc}{Tc} + \frac{1}{ae_e}\cdot\frac{Ve}{Te} + \sum_{i=1}^{n}\frac{Vw_i}{Tw_i}\right)}} \quad (1)$$

where

S=area of the working surface 2*a* of the piston 2

Pm=mean working gas pressure in the working space formed mainly by the compression space 4 and the expansion space 6.

M=total mass of the piston 2, the sleeve 16 and the armature coil 17.

To=ambient absolute temperature.

$ac_c$=Cp/Cv=(specific heat of the working gas in the compression space 4 at constant pressure)/(specific heat of the working gas in the compression space 4 at constant volume)

Vc=volume of the compression space 4.

Tc=mean operating absolute temperature of the working gas in the compression space 4.

$ae_e$=Cp/Cv=(specific heat of the working gas in the expansion space 6 at constant pressure)/(specific heat of the working gas in the expansion space 6 at constant volume).

Ve=volume of the expansion space 6.

Te=mean operating absolute temperature of the working gas in the expansion space 6.

$$\sum_{i=1}^{n}\left(\frac{Vw1}{Tw1}\right) = \left(\frac{Vw}{Tw}\right)_{cooler\ 5} + \left(\frac{Vw}{Tw}\right)_{regenerator\ 7} + \left(\frac{Vw}{Tw}\right)_{freezer\ 11}$$

where

Vw=volume of working gas of the associated heat exchanger.

Tw=mean absolute working gas temperature in the heat exchanger in operation.

An acceptable error between the angular frequencies $\omega_o$ and $\omega$ may be 10% or smaller.

In operation, when the a.c. power source having angular frequency $\omega_o$ which is substantially equal to $\omega$ defined by the equation (1) is connected to the contacts 21 and 22, the armature coil 17 is subjected to an axial Lorentz force due to the presence of the permanent magnetic field in the gap 23. As a result, the assembly of the piston 2, the sleeve 16 and the armature 17 resonates and vibrates axially. The vibration of the piston 2 causes a periodic pressure variation to occur in the working gas filling the working space formed by the compression space 4, the expansion space 6, the cooler 5, the regenerator 7, the center holes 8 and 9, the radial duct 10 and the freezer 11 and a resultant change of flow rate of gas through the regenerator 7 causes a periodically alternating driving force to be exerted on the displacer 3. Thus, the displacer 3 including the regenerator 7 is caused to reciprocated axially in the cylinder 1 at the same frequency as that of the piston 2 with different phase therefrom.

When the phase difference is kept constant suitably, the working gas in the working space repeats a thermodynamic cycle known as the "Inverse Stirling Cycle" and generates cold production mainly in the expansion gap 6 and the freezer 11.

The "Inverse Stirling Cycle" and the principle of generation of and cold states thereby is described in detail in "Cryocoolers", G. Walker, Plenum Press, New York, 1983, pp 117–123. In this specification, the principle will be described briefly.

The working gas in the compression space 4 which has been compressed by the piston 2 and heated thereby is cooled while flowing through the cooler 5 and flows into the hole 8 and then into the regenerator 7 in which it is further cooled by low temperature heat accumulated in a preceding half cycle. Then, it flows through the center hole 9, the radial duct 10 and the freezer 11 into the expansion space 6. After a substantial amount of the working gas is flown into the expansion space 6, an expansion stroke of the piston 2 is started and results in a lower temperature state in the expansion space 6. Then, the working gas flows in the reverse direction while giving the low temterature heat to the regenerator 7 into the compression space 4. In this cycle, the cold working gas absorbs heat of an external substance while passing through the freezer 11 to cool it. After a substantial amount of the working gas is returned to the compression space 4, the compression stroke is started again. The "Inverse Stirling Cycle" is completed in this manner. For more detail, the above mentioned article should be referred to.

In the conventional refrigerator, however, the angular resonance frequency defined by the equation (1) tends to be changed by leakage of the working gas through the seals, polytropic compression/expansion of the working gas and/or a use of mechanical springs of large spring constant. Therefore, it is difficult to constitute an efficient refrigerator.

SUMMARY OF THE INVENTION

An object of the present invention is to provide a refrigerator which is capable of operating with high efficiency even if there is leakage of working gas, etc.

According to the present invention, the above object can be achieved by setting an angular frequency of a.c. power supply for supplying power to a linear motor to $\omega_o$ which is substantially equal to an angular frequency $\omega$ defined by an equation (2) to be described. With such setting of the power source frequency, it is possible to obtain a resonance condition even if working gas leakage exists, resulting in a highly efficient refrigerator.

DETAILED DESCRIPTION OF THE PREFERRED EMBODIMENTS

Figure 1:
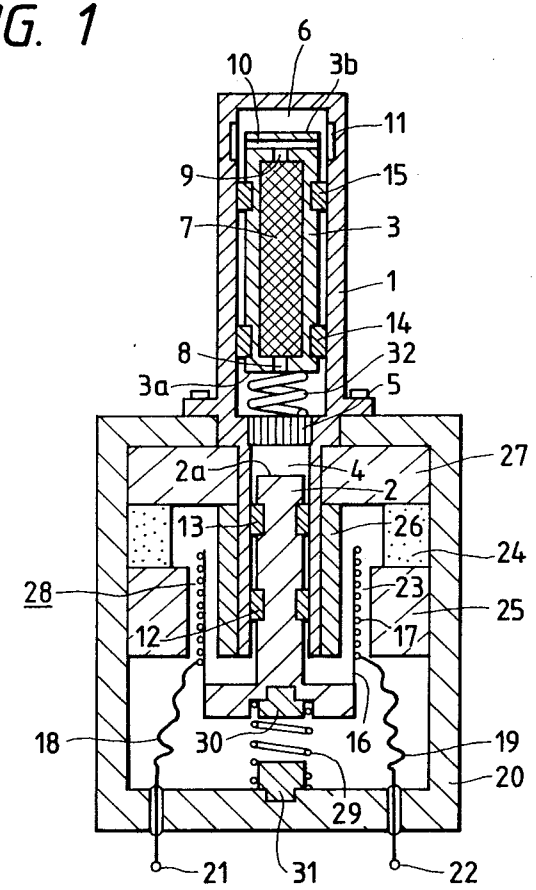
FIG. 1 is a cross sectional side view of an embodiment of a refrigerator according to the present invention.
Figure 4:
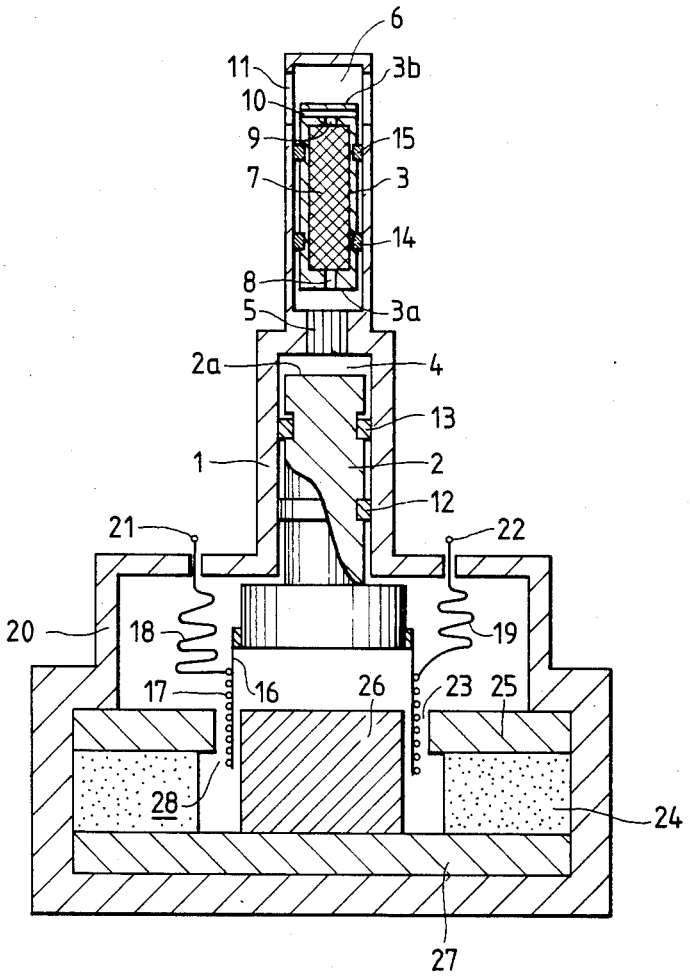
FIG. 4 is a cross section of a conventional refrigerator.

FIG. 1 shows an embodiment of the present invention, in which same or corresponding components as those in FIG. 4 are depicted by same reference numerals, respectively. In FIG. 1, a piston 2 is associated with a support coil spring 29 having a high spring constant to maintain a center of displacement of the piston 2 against gravity and acceleration forces at a constant position. Opposite ends of the spring 29 are fixed to protrusions 30 and 31, respectively, which are fixed to the piston 2 and a housing 20, respectively, so that a restitution force is exerted on the piston 2 correspondingly to a displacement of the piston 2 from the constant center position.

Further, a coil spring 32 is provided below a displacer 3. Opposite ends of the spring 32 are fixed to a lower surface 3*a* of the displacer 3 and a cylinder 1, respectively, so that the displacer 3 vibrates at the same frequency as that of the piston 2 but with different phase when the piston vibrates.

In this embodiment, an armature coil 17 is supplied through contacts 21 and 22 with power from an a.c. power source having an angular frequency $\omega_o$ which is substantially equal to an angular frequency——defined by the following equation:

$$\omega = \sqrt{\frac{1}{m}\left(\frac{2 \cdot Sp \cdot Pa \cdot \cos_\alpha}{S} + Ks\right)} \tag{2}$$

where m=total mass of a reciprocation portion composed of the piston 2, a sleeve 16 and the armature coil 17 or a permanent magnet 24.

Sp=area of a working surface 2*a* of the piston 2.

Figure 2:
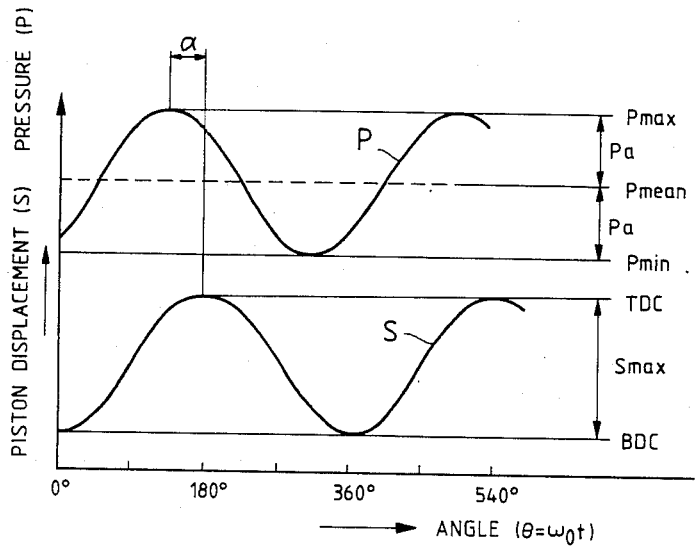
FIG. 2 is a timing chart showing an operational relation between a piston displacement and a pressure variation of working gas in a compression space.

Pa=amplitude of pressure variation of a working gas in a compression space 4. (FIG. 2)

$\alpha$=phase difference between a displacement of the piston 2 and pressure variation of the working gas in the compression space 4. (FIG. 2)

S=stroke of the piston 2. (FIG. 2)

Ks=spring constant of the spring 29. (in case of no spring 29, Ks=0)

Further, an acceptable error between the frequencies $\omega$ and $\omega_o$ is set within $\pm 10\%$.

In operation, when the power source having an angular frequency $\omega_o$ is connected across the contacts 21 and 22, the armature coil 17 is subjected to an axial Lorentz force under the magnetic field in the gap 23.

On the other hand, since an assembly including the piston 2, the sleeve 16 and the armature coil 17 constitutes a mass/spring vibration system with the working gas in the working space which acts as a gas spring and the support spring 29 which is mechanical, the assembly starts to vibrate axially by the Lorentz force acting on the armature coil 17. A vibration of the piston 2 produces a periodical pressure variation of the working gas in the working space and a periodically alternating axial driving force of the diaplacer 3 is produced by a resultant variation of flow rate of the gas passing through the regenerator 7. Thus, the displacer 3 including the regenerator constitutes the vibration system with the mechanical spring 32 and the displacer 3 system reciprocates in the cylinder 1 at the same angular frequency as the angular frequency $\omega_o$ of the piston 2 with different phases from each other. When the difference in phase between the piston 2 and te displacer 3 is suitable, the aforesaid "Inverse Stirling Cycle" is established, resulting in the cold production mainly in the expansion space 6 and the freezer 11, as mentioned previously.

That is, in a refrigerator having a relatively high stiffness spring as a support spring, a refrigerator in which working gas leakage through seals exists or a refrigerator in which polytropic compression/expansion occurs, an angular resonance frequency of a piston/armature coil assembly is given by the equation (2) proximately. Therefore, such refrigerator can be operated efficiently by connecting an a.c. power source having an angular frequency $\omega_o$ substantially equal to the angular frequency $\omega$ to moving the armature coil.

Figure 3:
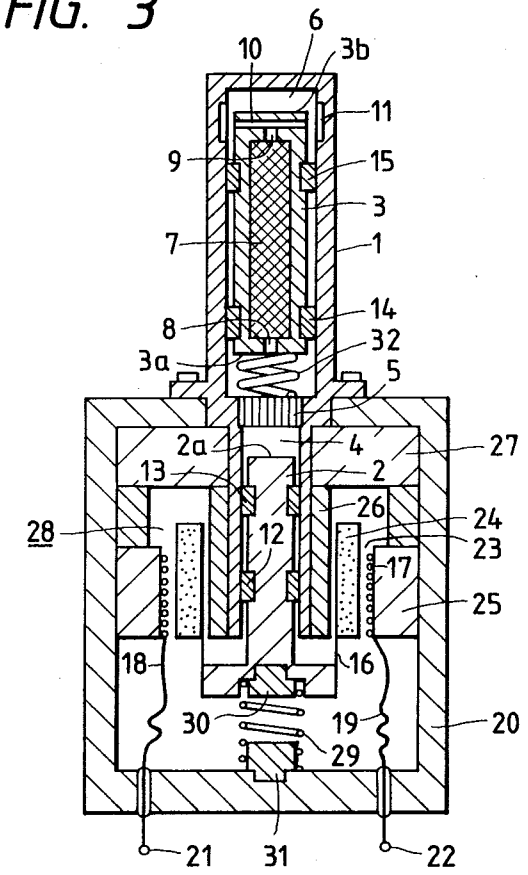
FIG. 3 is a similar view to FIG. 1, showing another embodiment of the present invention.

FIG. 3 shows another embodiment of the present invention which differs from the embodiment shown in FIG. 1 in that, although, in FIG. 1, the linear motor 28 is of a moving coil type in which the armature coil 17 reciprocates, a linear motor 28 in FIG. 3 is of a moving magnet type. That is, in FIG. 3, the magnet 24 is mounted on the sleeve 16 and the armature coil 17 is fixedly mounted on the armature 25. It is also possible to use a moving armature core type. In either case, a mass of the magnet or the armature core should be considered as a mass of the reciprocating portion of the device.

The support spring 29 for the piston may be removed. In such case, Ks in the equation (2) becomes 0.

As describd, according to the present invention, the piston/armature assembly can be maintained in a resonance state even if there is working gas leakage through a piston seal. Therefore, the efficiency of the linear motor is improved, resulting in a highly efficient, compact and light-weight refrigerator.

What is claimed is:

1. A regrigerator having a working space including a compression space held at a relatively high temperature during operation and having a volume varied according to a displacement of a piston arranged adjacent said compression space or displacements of said piston and a displacer, an expansion space held at a relatively low temperature during operation and having a volume varied according to said displacement of said displacer arranged adjacent said expansion space, a cooler, a regenerator and a freezer disposed between said compression space and said expansion space to communicate therebetween and a working gas filling said working space and performing a thermodynamic cycle by movements of said piston and said displacer in different phase to generate a cold production therein, comprising a linear motor including an armature coil and a closed magnetic circuit for driving said piston, a support spring for supporting said piston in a constant position in a stationary condition and a power source for driving said armature coil, wherein an angular resonance frequency $\omega$ of a reciprocation portion including said piston and a portion of said linear motor is defined by the following equation:

$$\omega = \sqrt{\frac{1}{m}}\left(\frac{2 \cdot Sp \cdot Pa \cdot \cos\alpha}{S} + Ks\right)$$

where m=total mass of said reciprocation portion

SP=area of a working surface of said piston

Pa=amplitude of pressure variation of said working gas in said compression space $\alpha$=phase difference between a displacement of said piston and pressure variation of said working gas in said compression space S=stroke of said piston Ks=spring constant of said support spring and wherein an angular frequency of said power source $\omega_o$ is substantially equal to said angular resonance frequency $\omega$ with an acceptable error therebetween being $\pm 10\%$.

2. The refrigerator as claimed in claim 1, wherein Ks is zero.

3. The refrigerator as claimed in claim 1, wherein said portion of said linear motor includes said armature coil.

4. The refrigerator as claimed in claim 1, wherein said portion of said linear motor includes an armature core.

5. The refrigerator as claimed in claim 1, wherein said portion of said linear motor includes a permanent magnet.

* * * * *

UNITED STATES PATENT AND TRADEMARK OFFICE

CERTIFICATE OF CORRECTION

PATENT NO. : 4,822,390

DATED : April 18, 1989

INVENTOR(S) : Yoshio KAZUMOTO et al

It is certified that error appears in the above—identified patent and that said Letters Patent is hereby corrected as shown below:

On the title page, in the ABSTRACT, and in Claim 1, column 6, line 7, in the formula, the square root symbol should extend across the entire right side of the equation, as correctly shown in column 4, line 9 of the specification.

Signed and Sealed this

Twenty-first Day of August, 1990

*Attest:*

HARRY F. MANBECK, JR.

*Attesting Officer*

*Commissioner of Patents and Trademarks*